US006419200B1

(12) United States Patent
Tuneld et al.

(10) Patent No.: US 6,419,200 B1
(45) Date of Patent: Jul. 16, 2002

(54) DEVICE AT A CHRISTMAS-TREE STAND

(75) Inventors: Ulf Tuneld, Vindarnas väg 4 SE-429 35, Kullavik (SE); Lars Johnsson, deceased, late of Kullavik (SE), by Helny Lisbeth Johnsson, heir

(73) Assignee: Ulf Tuneld (SE)

( * ) Notice: Subject to any disclaimer, the term of this patent is extended or adjusted under 35 U.S.C. 154(b) by 0 days.

(21) Appl. No.: 09/720,924

(22) PCT Filed: Jun. 22, 1999

(86) PCT No.: PCT/SE99/01119

§ 371 (c)(1),
(2), (4) Date: Dec. 28, 2000

(87) PCT Pub. No.: WO00/00068

PCT Pub. Date: Jan. 6, 2000

(30) Foreign Application Priority Data

Jun. 29, 1998 (SE) ..... 9802309

(51) Int. Cl.[7] ..... F16M 13/00
(52) U.S. Cl. ..... 248/514
(58) Field of Search ..... 248/514, 515, 248/516, 519

(56) References Cited

U.S. PATENT DOCUMENTS

| | | | | |
|---|---|---|---|---|
| 4,541,601 A | | 9/1985 | Corbisello | 248/516 |
| 4,549,710 A | | 10/1985 | Prince et al. | 248/183 |
| 4,645,153 A | * | 2/1987 | Granzow et al. | 248/178 |
| 5,393,031 A | | 2/1995 | Leve | 248/516 |
| 5,484,131 A | * | 1/1996 | Aldrette et al. | 248/527 |
| 5,707,037 A | | 1/1998 | Pastrick | 248/516 |
| 6,019,341 A | * | 2/2000 | Brown et al. | 248/516 |
| 6,094,859 A | * | 8/2000 | Kalman et al. | 248/516 X |

FOREIGN PATENT DOCUMENTS

| | | | |
|---|---|---|---|
| DE | 3601601 | 7/1987 | A47G/33/12 |

* cited by examiner

*Primary Examiner*—Ramon O. Ramirez
(74) *Attorney, Agent, or Firm*—Orum & Roth

(57) ABSTRACT

The invention relates to an arrangement (1) for a Christmas tree stand (2) comprising a bottom part (3) and a tree-accommodating supporting part (4; 304) which is supported by the bottom part (3; 303), whereby adjustment means (5) are provided between the aforementioned pails (3, 4) to permit adjustment of the aforementioned tree-holding supporting part (4) at the desired angle. The central part (9) of the bottom part (3) exhibits a curved external convex contact surface (10) for the purpose of forming a supporting surface along the same for a spring (8) capable of making contact with it. A connection (11) extends through the central part (9) between the spring (8) and a holder (18) capable of being accommodated in the internal accommodating part of the aforementioned central part, which holder is attached to the supporting pan (4) and the spring (8).

10 Claims, 9 Drawing Sheets

DEVICE AT A CHRISTMAS-TREE STAND

The present invention relates to an arrangement for a Christmas tree stand comprising a bottom part and a part supported by it, whereby adjustment means are provided between the aforementioned parts to permit adjustment of the aforementioned tree-accommodating supporting part to the desired angle.

Adjustable Christmas tree stands are previously disclosed through, for example, U.S. Pat. No. 4,913,395, DE 3,421,733 C2 and DE 3804670 A1. It is necessary, however, to actuate screws and similar when it is wished to vary the angular adjustment of the tree.

The principal object of the present invention is thus, in the first instance, to solve the aforementioned problem and to permit angular adjustment of the tree in the Christmas tree stand without having to unpack a tool kit in order to do this.

The aforementioned object is achieved by means of an arrangement in accordance with the present invention, which is characterized essentially in that the central part of the bottom part exhibits a curved external convex contact surface for a spring capable of making contact with it, and in that a connection extends through the central part between the spring and a holder capable of being accommodated in the internal accommodating part of the aforementioned central part, which holder is attached to the supporting part.

The invention is described below in the form of a number of preferred illustrative embodiments of the invention, in conjunction with which reference is made to the accompanying drawings, in which FIG. 1 shows a cross-sectional view of a first illustrative embodiment of a Christmas tree stand in the erected position;

Figure 1:
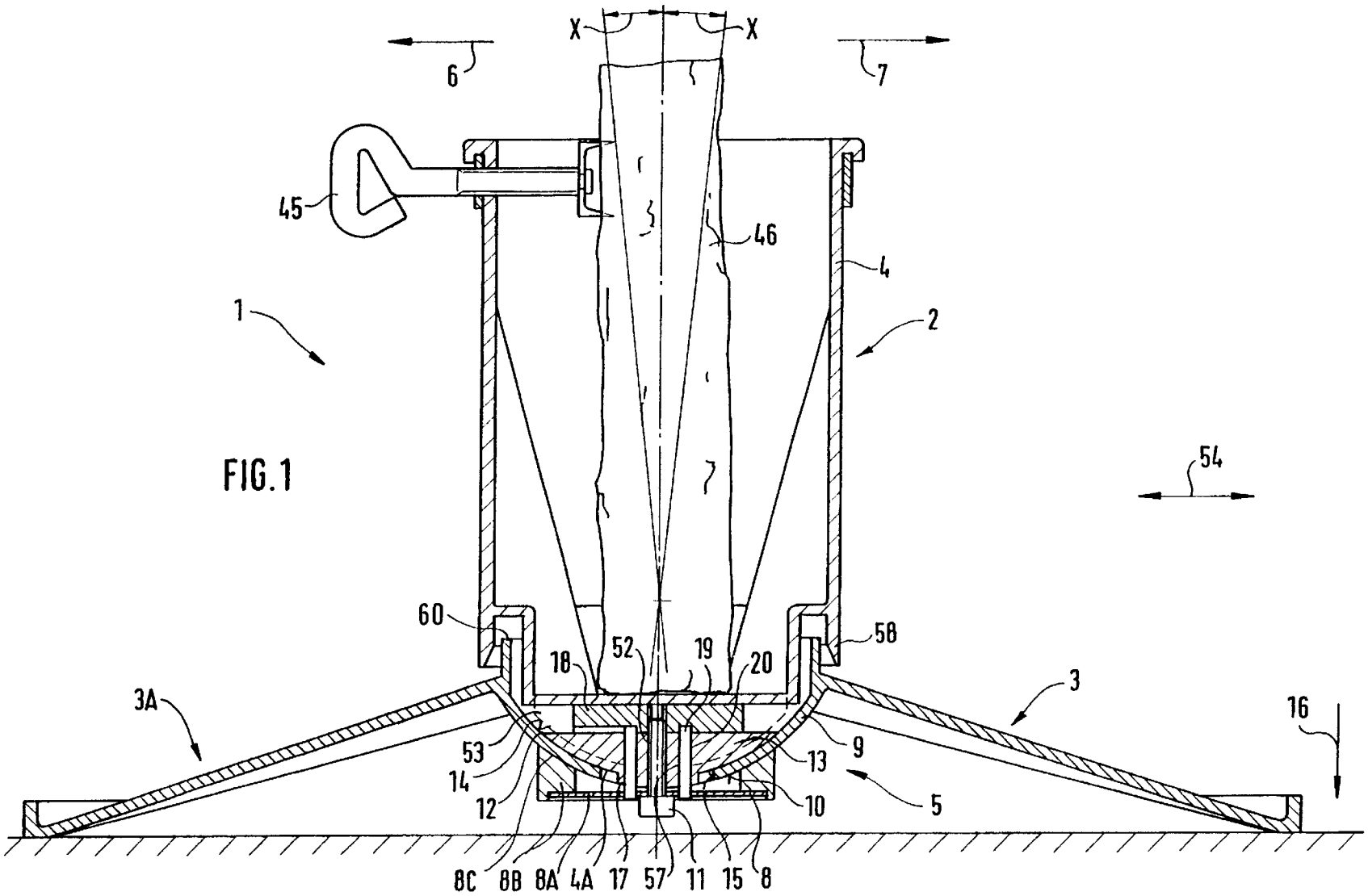
Figure 2:
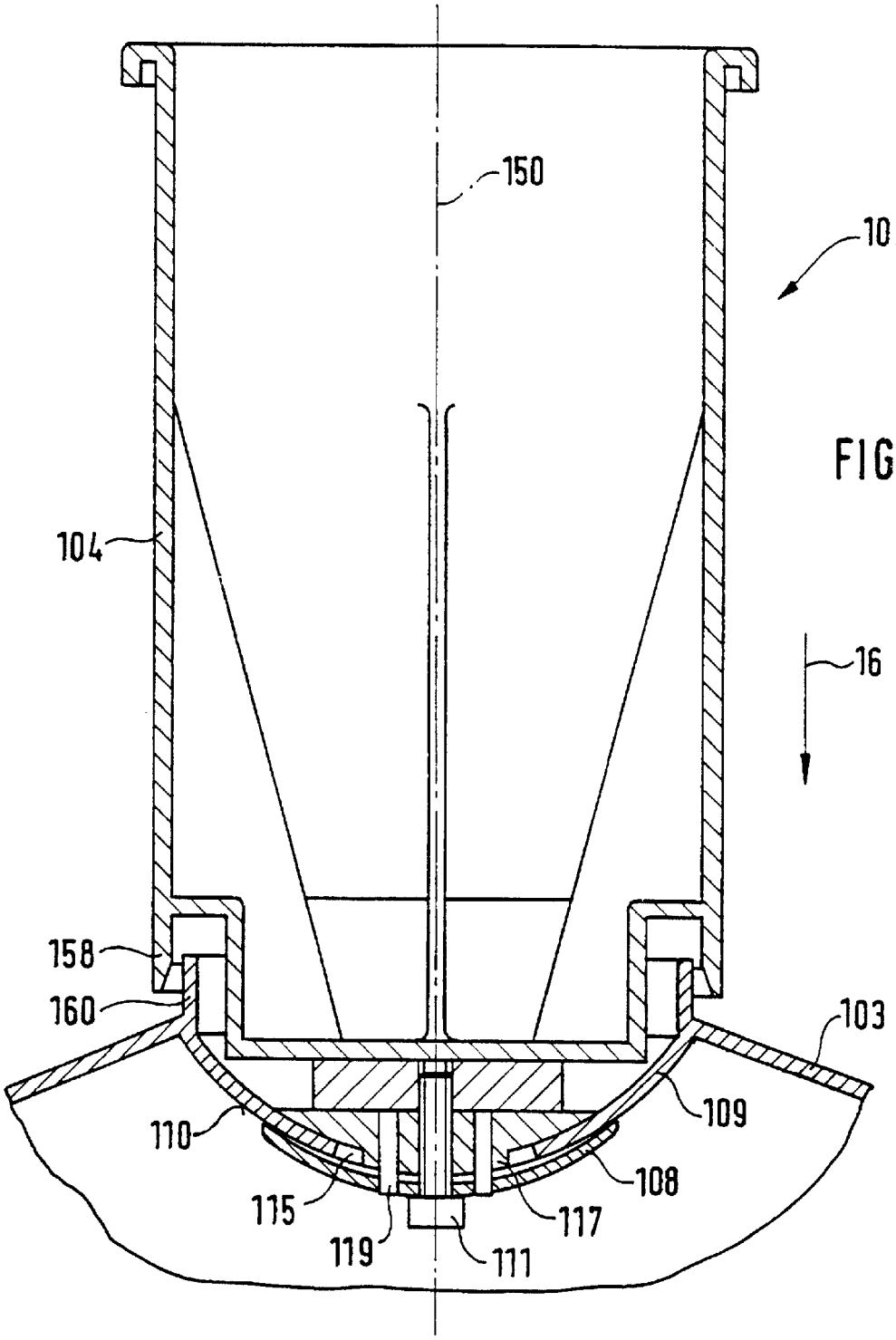
FIG. 2 shows a cross-sectional view of a second illustrative embodiment of part of a Christmas tree stand adjusted to an upright position.
Figure 3:
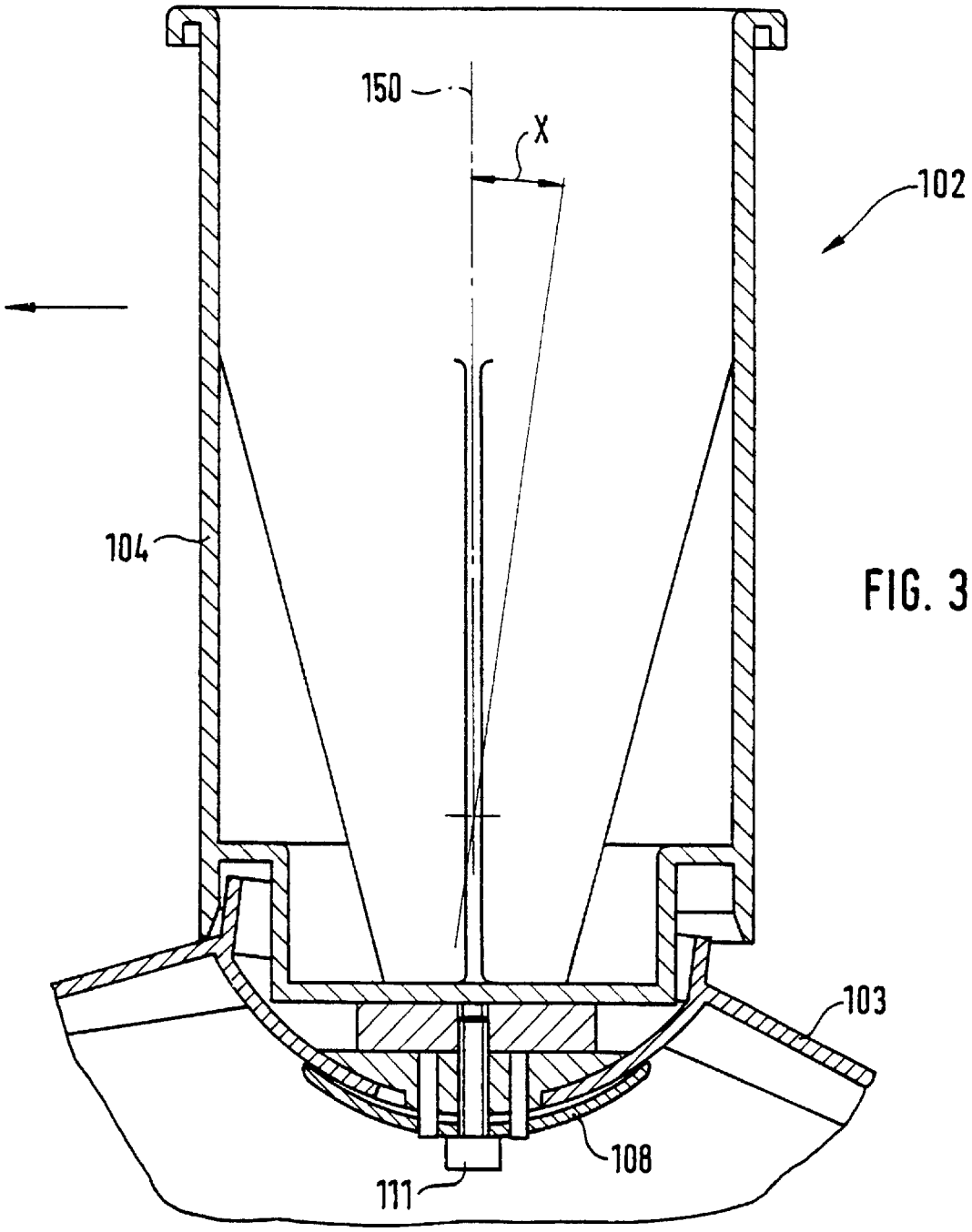
FIG. 3 shows the aforementioned Christmas tree stand adjusted to an inclined position.

An arrangement 1 for a Christmas tree stand 2 comprising a bottom part 3, and a tree-accommodating supporting part 4; 304, which is supported by the bottom part 3; 303, has means of adjustment 5 between the aforementioned parts 3, 4 to permit the adjustment of the aforementioned tree-accommodating supporting part 4 to a desired angle X of approximately 5° in each direction 6, 7 along the periphery of the aforementioned bottom part 3, and exhibits a spring 8 to hold the parts together at the desired angle X.

The central part 9 of the bottom part 3 exhibits a curved outer convex contact surface 10 for a spring 8 capable of bearing against it. A connection 11 extends through the central part 9 between the spring 8 and a holder 13 capable of being accommodated in the internal accommodating part of the aforementioned central part, which holder is attached to the supporting part 4.

The downward-facing, spherical, curved bottom part 4A of the supporting part 4 exhibits a congruent form with a corresponding concave, internally curved accommodating surface 14 in the bottom part 3 of the central part 9.

The central part 9 of the bottom part 3 exhibits a central opening 15, in which a stopping part 17 projecting from the superjacent supporting part 4 in a downward direction 16 is accommodated in a movable fashion such that it is capable of adjustment to the desired angle X for the supporting part 4.

The aforementioned stopping part 17 is also connected to the spring 8, in conjunction with which the connection comprises an adjustable screw 11 accommodated in a retainer 18 in the supporting part 4.

The spring 8 comprises, in the first illustrative example shown in FIG. 1, a sprung disc 8A with an annular contact edge 8B with a correspondingly shaped pressure surface 8C which makes contact with the aforementioned contact surface 10 of the bottom part 3.

Each of two pins 19 projects from the sprung 8 and into its corresponding opening 20 in the supporting part 4, where it functions as a spring guide so that the spring 8 and the supporting part 4 do not change position in relation to one another.

According to other embodiments, the spring 108 is in the form of a spherical, curved spring washer consisting of springy metal, the curvature of which in the unloaded position differs from the downward-facing 16 curved external contact surface 110 of the bottom part 3, i.e. the spring 108 exhibits a curvature of which the radius R1 is less than the radius R2 of the aforementioned contact surface 110. See FIG. 9.

This embodiment of a Christmas tree stand 102 also exhibits a guide pins 119 for the spring 108, which is also held securely in a centrally located frame part of the supporting part 104 and forms a projecting stopping part 117 accommodated in a circular central opening 115 in the central part 109 of the bottom part 103 in order to limit any tipping of the supporting part 104 around the vertical central axis 150 of the stand. Holes 57; 157 in the spring 8; 108 accommodate the pins 19, 110. The accommodating openings 120 for the aforementioned pins 119 in the aforementioned frame part in the supporting part 104 retain the pins 119 and with it the spring 108 in position on the supporting part 104. A threaded insert 18; 118 attached to the center of the supporting part 104 and functioning as a holding part provides an attachment for a screw 11, 111 which is screwed in through a centrally located opening 52, 152 in the spring 8; 108.

The aforementioned insert 18; 118 which forms a holding part may comprise a piece of iron or some other holding part with matching threads capable of being introduced into a laterally 54, 154 extending channel 53, 153.

Figure 4A:
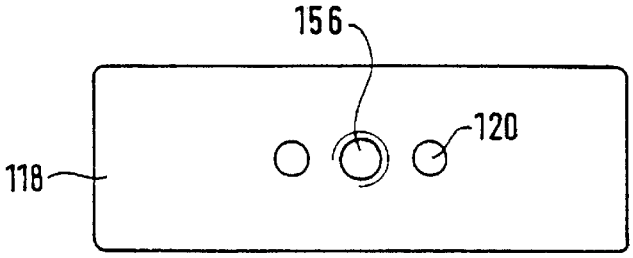
FIG. 4 shows a detailed sectional view of the Christmas tree stand with the securing component for the spring extended.
Figure 4:
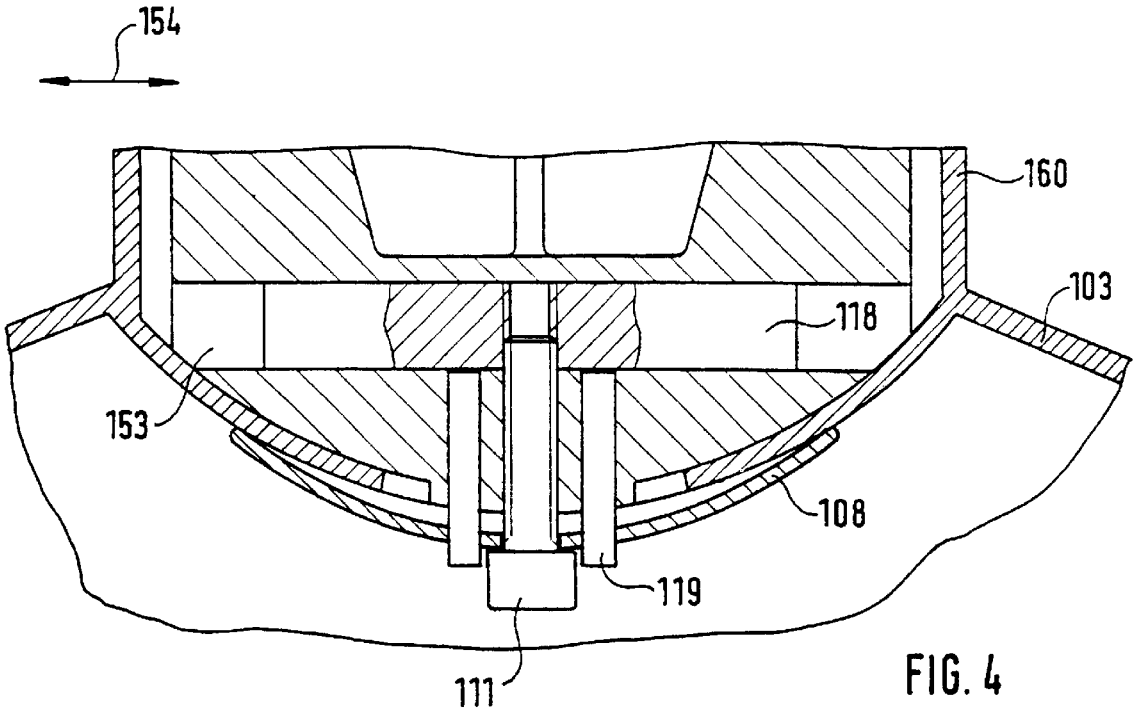

Illustrated in FIGS. 4 and 4A is a piece of iron 118 of this kind which forms a holding part with a threaded hole 156 for the screw 111 and two openings 120 for the pins 119.

The stop part thus projects downwards from the frame part in such a way that it is capable of being adjusted in the central opening in the central part to the extent that, at its full inclination, it comes into contact with the peripheral edge of the opening, thereby stopping further angular adjustment of the supporting part 4; 104. The aforementioned supporting part is tubular, and the frame part 3; 103 is disc-shaped with sides 3A; 103A inclined at a shallow angle and has a centrally located, upward-projecting collar 60, 160, in conjunction with which an annular lower part 58; 158 in the supporting part 4, 104 is so arranged as to enclose the aforementioned collar 60, 160, thereby preventing water from running down over the collar 60, 160 into the lower part of the stand.

Figure 5:
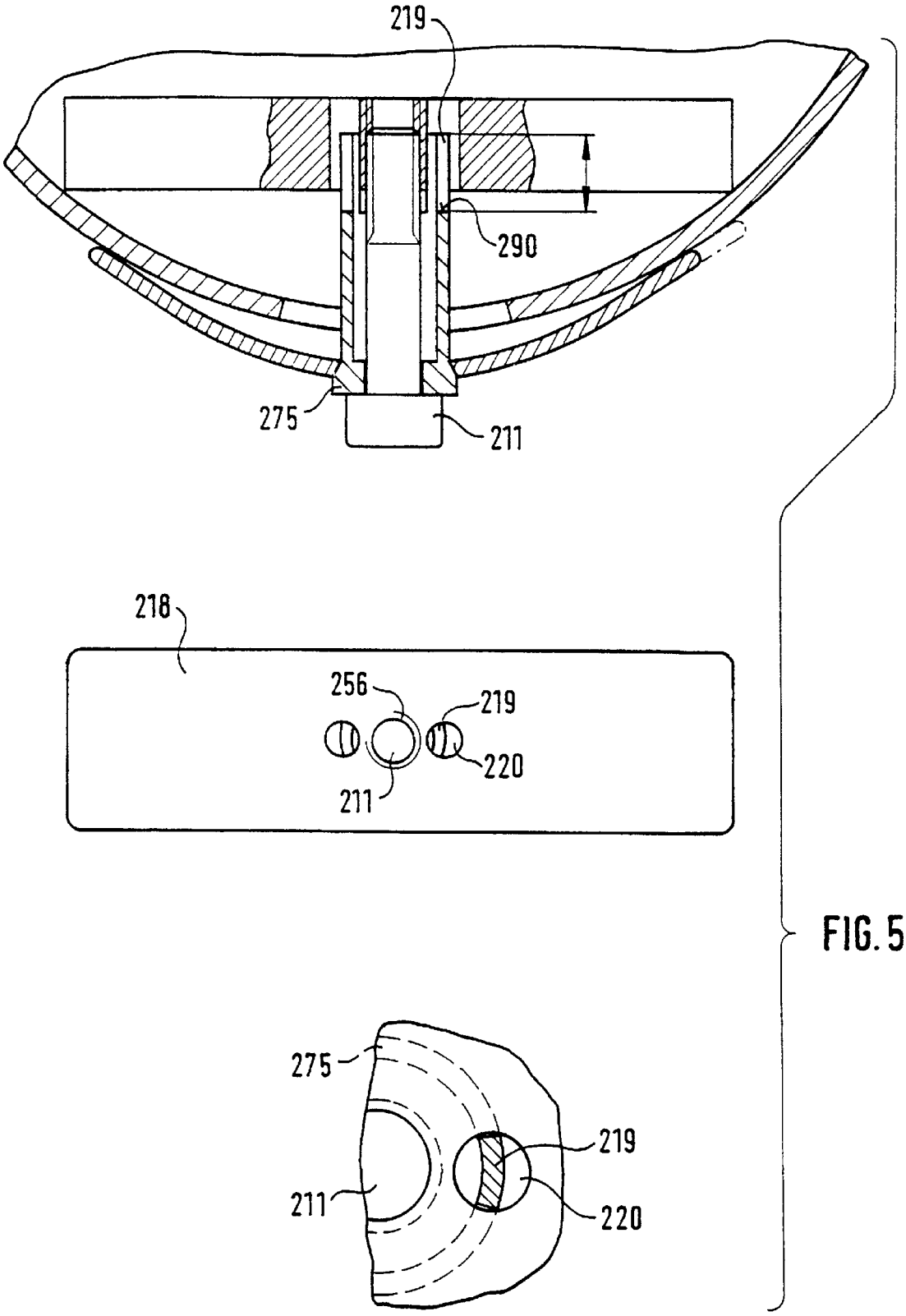
FIG. 5 shows a variant of the spring attachment in a stand.
Figure 6:
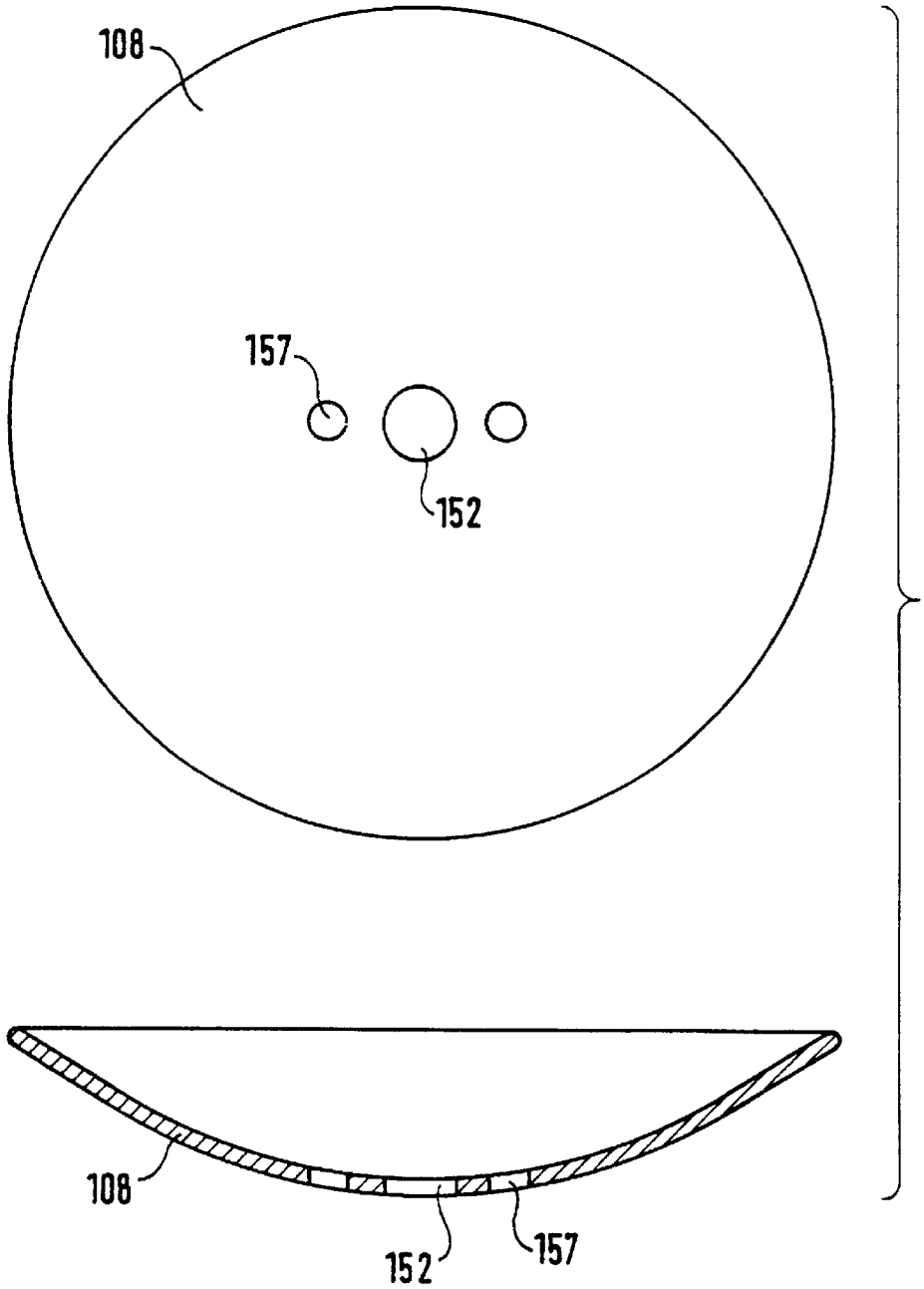
FIG. 6 shows a plan view and a sectional view of a spring element.
Figure 7:
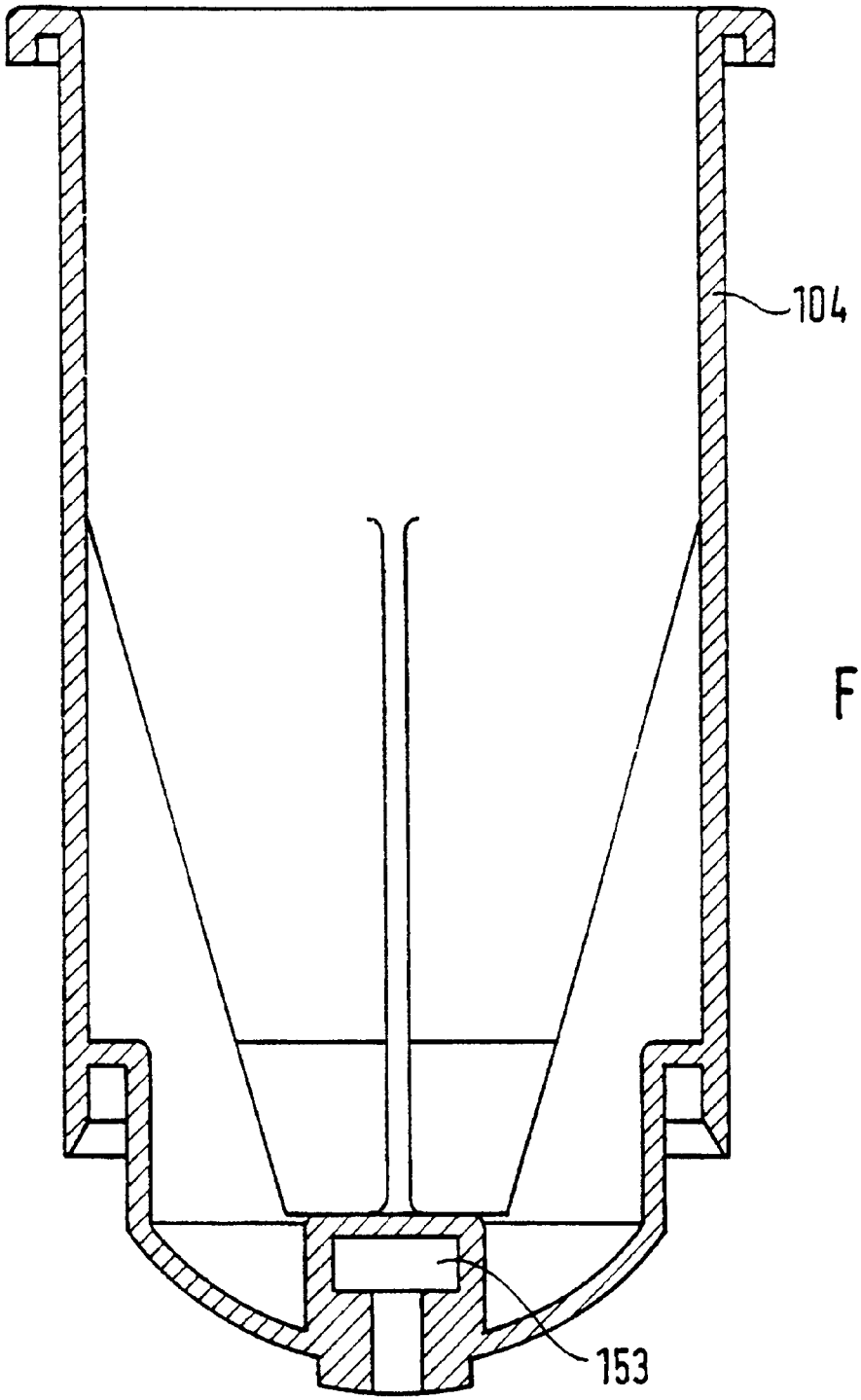
FIG. 7 shows a sectional view of a tree-supporting part.

A similar connecting part is illustrated in FIG. 5, in conjunction with which the pins 219 are formed by a common part in the form of a sleeve 275, in which a screw 211 is accommodated and is screwed into a piece of iron 218 which forms a stopping part provided with a threaded hole 256, 220, as described above.

Figure 8:
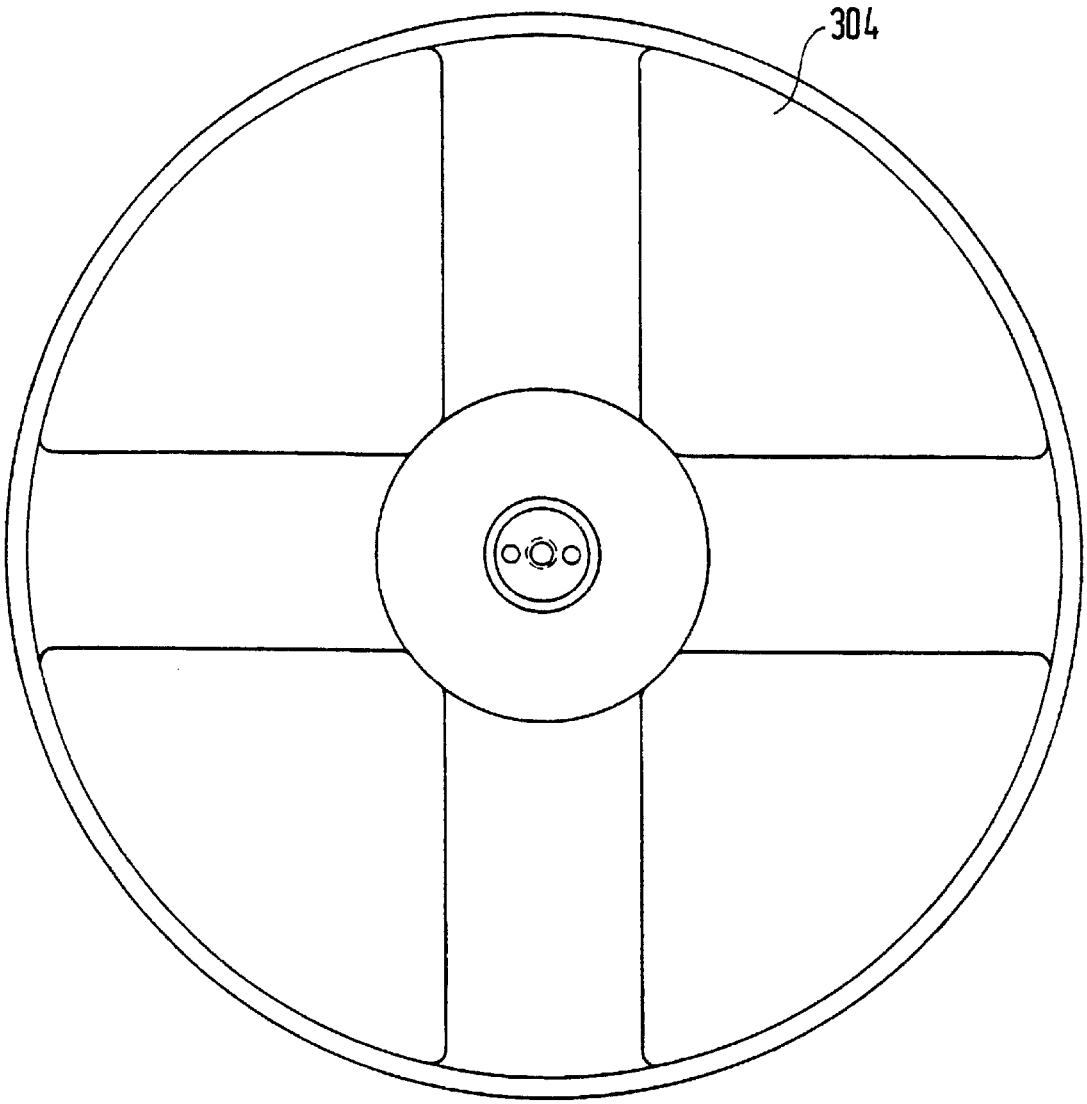
FIGS. 8–9 show a final solution for a Christmas tree stand, with the underside of a supporting part and a sectional view of the stand in the assembled state illustrated.
Figure 9:
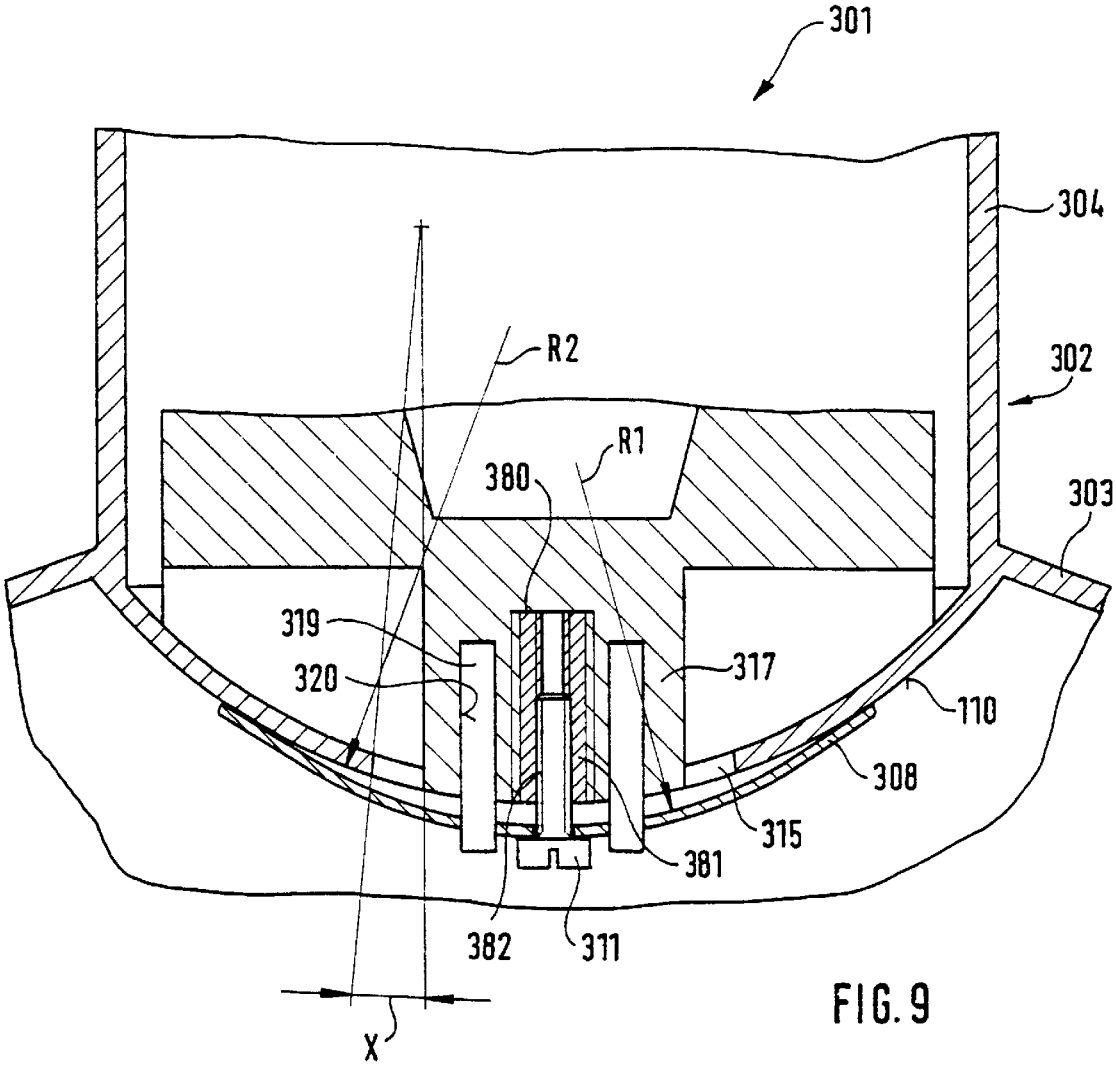

The embodiment of a stand 302 illustrated in FIGS. 8 and 9 differs from the stands described above and in the other Figures in that the screw 311 connecting the spring 308 to the supporting part 304 at its bottom part is accommodated screwed into a sleeve 381 secured in an opening 380 in the bottom part, which sleeve has internal threads 382 to interact with the screw 311.

Furthermore, the pins 319 are accommodated in holes 320 in the formed stopping part 317 that is accommodated in an opening 315 in the bottom of the bottom part 303. The function of the aforementioned arrangement 301 is the same as that described above.

By screwing the screw 11, 111, 211, 311 to a different extent into the supporting part 4, 104, 204, 304, it is possible to adjust the desired spring force so that the supporting part can be tilted manually to the desired angle X after securing a Christmas tree in it by means of upper securing screws 45 around its periphery, for example if the Christmas tree 46 is inclined.

By adapting the distance so that the spring is caused to make contact with the stopping part 17, a suitable spring force will have been achieved to enable the Christmas tree to be adjusted conveniently in the desired direction, and to ensure that the Christmas tree also stands securely in the stand.

The sleeve 275 illustrated in FIG. 5 functions in this case as a distance piece in the manner described above, in that a contact edge 290 of the sleeve 275 comes into contact with the piece of iron 218 acting as a holder and a stopping part.

The invention is not restricted to the illustrative embodiments described above and illustrated in the drawings, but may be varied within the scope of the Patent Claims without departing from the idea of invention.

What is claimed is:

1. Arrangement (1; 301) for a Christmas tree stand (2; 302), comprising:

a bottom part (3; 303) and a tree accommodating supporting part (4; 304) which is supported by the bottom part (3; 303), whereby adjustment means (5) are provided between the aforementioned parts (3; 303, 4; 304) to permit adjustment of the aforementioned tree-holding supporting part (4; 304) to a desired angle (x), a central part (9) of the bottom part (3; 303) exhibits a curved external convex contact surface (10; 310) for a spring (8; 308) capable of making contact with it, and in that a connection (11; 311) extends through with the central part (9) between the spring (8; 308) and a holder (18) capable of being accommodated in an internal accommodating part of the aforementioned central part, which holder is attached to the supporting part (4; 304).

2. Arrangement in accordance with patent claim 1, characterized in that the supporting part (4) exhibits a congruent form with a corresponding concave, internally curved accommodating surface (14).

3. Arrangement in accordance with patent claim 2, characterized in that the central part (9) exhibits a central opening (15), in which a stopping part (17) projecting downwards from the superjacent supporting part (4) is accommodated in a movable fashion such that it is capable of adjustment to the desired angle for the supporting part (4).

4. Arrangement in accordance with patent claim 3, characterized in that the stopping part (17) is connected to the spring (8).

5. Arrangement in accordance with patent claim 4, characterized in that the connection comprises an adjustable screw (11), which is accommodated in a holder functioning as a retainer (18) in the supporting part (4).

6. Arrangement in accordance with patent claim 5, characterized in that the spring (108) is in the form of a spherical, curved spring washer, the curvature of which differs from the downward-facing (16) curved contact surface (12) of the bottom part (3).

7. Arrangement in accordance with patent claim 6, characterized in that two pins (19) project from the spring (8) and into corresponding openings (20) in the supporting part (4).

8. Arrangement in accordance with patent claim 7, characterized in that the accommodating openings (20, 120) accommodate the aforementioned pins (19; 119) and the spring (8; 108) in position on the supporting part (4; 104),in conjunction with which a threaded insert (18; 118) attached to the supporting part (4; 104) provides an attachment for a screw (11; 111) which is screwed in through a centrally located opening (52; 152) in the spring (8; 108).

9. Arrangement in accordance with patent claim 8, characterized in that the stop part (17; 117) projects from the frame part (18, 118) in such a way that it is capable of being adjusted in the central opening (15; 115) in the central part (9, 109) so that it comes into contact with the peripheral edge of the opening, thereby stopping further angular adjustment of the supporting part (4; 104).

10. Arrangement in accordance with patent claim 9, characterized in that the supporting part (4; 104) is tubular, and in that the frame part (3; 103) is disc-shaped with a centrally located, upward-projecting collar (60, 160), in conjunction with which an annular lower part (58; 158) in the supporting part (4, 104) is so arranged as to enclose the aforementioned collar (60, 160), in conjunction with which the aforementioned parts preferably consist of a plastic material.

* * * * *